United States Patent [19]

Spiegelman

[11] Patent Number: 4,466,517

[45] Date of Patent: Aug. 21, 1984

[54] TOP OPENING TOTEBAG BODY REST

[76] Inventor: Kathleen Y. Spiegelman, 3627 Serra Rd., Malibu, Calif. 90265

[21] Appl. No.: 346,520

[22] Filed: Feb. 8, 1982

[51] Int. Cl.[3] ..... A45C 9/00; A45C 13/26

[52] U.S. Cl. ..... 190/8; 190/2; 5/419; 297/377; 383/4; 383/15

[58] Field of Search ..... 150/29, 31, 1.7, 12, 150/51, DIG. 1, 33; 190/2, 8, 49, 117; 5/419; 229/52 A, 54 C; 220/95; 248/95, 74.3, 74.5; 297/350, 377, 441; 383/4, 12, 15

[56] References Cited

U.S. PATENT DOCUMENTS

| | | | |
|---|---|---|---|
| 1,495,548 | 5/1924 | Cline | 220/95 X |
| 1,625,038 | 4/1927 | Love | 220/95 X |
| 1,815,106 | 7/1931 | Jostes | 150/31 X |
| 1,873,911 | 8/1932 | Walker | 150/29 UX |
| 2,044,717 | 6/1936 | McElmoyl | 190/8 |
| 2,487,145 | 11/1949 | Kuhlman | 150/1.7 X |
| 2,577,670 | 12/1951 | Adams | 150/12 X |
| 3,189,382 | 6/1965 | Fortier | 297/441 |
| 3,232,503 | 2/1966 | Thonen | 150/1.5 B |
| 3,486,684 | 12/1969 | Dills et al. | 150/12 X |
| 4,194,601 | 3/1980 | Yellin | 190/2 |
| 4,273,221 | 6/1981 | Poag | 190/8 |
| 4,316,629 | 2/1982 | Jacoby | 229/52 A X |

FOREIGN PATENT DOCUMENTS

| | | | |
|---|---|---|---|
| 78655 | 10/1919 | Fed. Rep. of Germany | 190/49 |
| 50174 | 1/1940 | France | 150/42 |
| 286295 | 10/1952 | Switzerland | 297/377 |
| 216920 | 6/1924 | United Kingdom | 190/2 |
| 614807 | 12/1948 | United Kingdom | 150/42 |
| 614688 | 12/1948 | United Kingdom | 190/8 |
| 995760 | 6/1965 | United Kingdom | 220/95 |

*Primary Examiner*—William Price
*Assistant Examiner*—Sue A. Weaver
*Attorney, Agent, or Firm*—Robert B. Block; Lewis Anten

[57] ABSTRACT

A tote bag body rest having a snap-releasable, hinged handle pair arranged to be easily disconnected at the top to give larger object access to the bag. It can be easily snapped closed to provide a hinge from which the bottom can open to form a self supporting unit and further remains closed to secure the handle together under the load of a person leaning against it. The unit comprises a fabric bag separately and completely manufactured apart from the frame to which it is later assembled.

4 Claims, 28 Drawing Figures

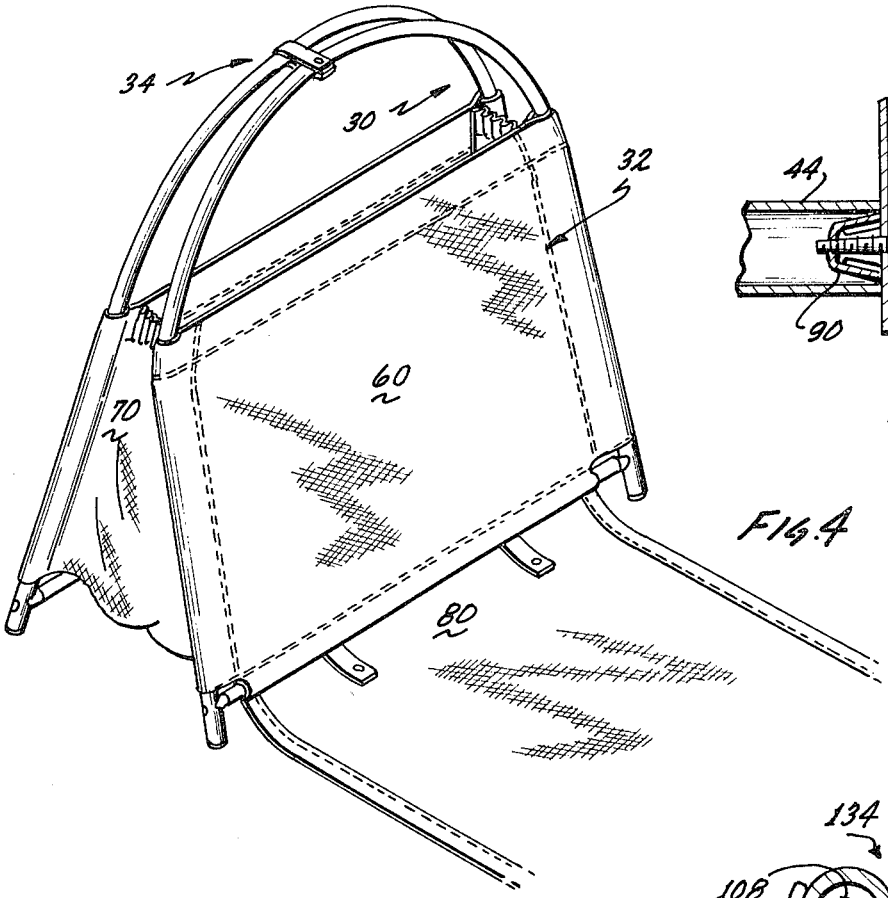
FIG. 4
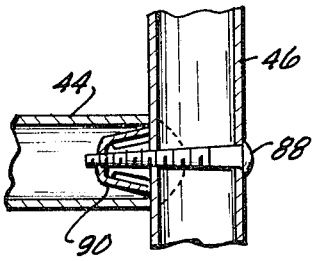
FIG. 6C
FIG. 10
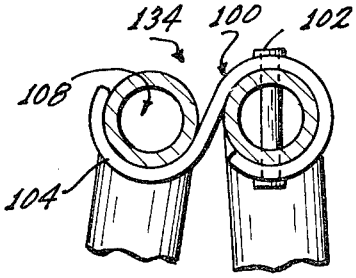
FIG. 9
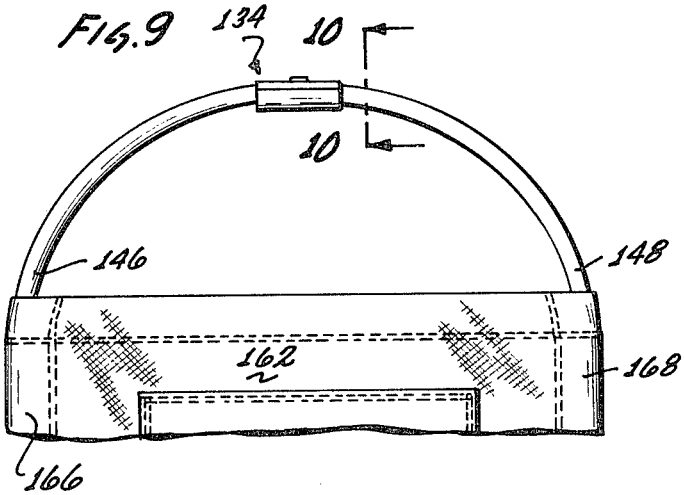
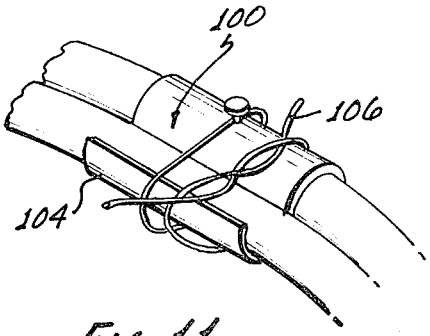
FIG. 11

TOP OPENING TOTEBAG BODY REST

BACKGROUND OF THE INVENTION

This invention relates to totebags usable as backrests such as are disclosed in my U.S. Pat. No. 4,194,601 issued Mar. 25, 1980. More particularly, this invention relates to such totebags enabling easier top access and opening, surer footing and positioning in sandy or loose ground when used as a backrest and to a more effective construction adapted for ease and economy of manufacture.

The referenced patent describes an especially useful article providing an improved combination totebag and backrest in which the frame of the bag is hingedly connected at the handle, opens at the feet, and, when supported by the cloth of the bag may be arranged as stable A-frame structure. The bag includes a seat flap which extends under the user and upon which one may sit while leaning backwards against the open bag and frame. As disclosed in said patent, the frame structure is pivotly connected by a hinge at the handle which for reasons of security when resting against the same does not release. It would be desirable if the hinge could be arranged to be selectively releasable in a convenient and reliable way so as to facilitate opening the top of the bag to place objects in it. The construction of such a hinge would have to be very reliable when being leaned against so as to avoid collapse of the bag in use as a backrest. Also the original totebag was assembled with frame members so shaped that the sewing operations required for attaching the bag after assembly over the frame required special type of sewing machine arm. And, while the original bag disclosed in U.S. Pat. No. 4,194,601 was desirably smooth in contour particularly at the lower edges, this desirable feature of appearance was obtained only with the omission of extensions which would have provided greater stability to the bag in sand or loose soil. There is therefore a need for a new and improved totebag and backrest combination structure, and method of manufacture which will provide these features.

SUMMARY OF THE INVENTION AND OBJECTS

It is the general object of the present invention to provide an improved totebag body rest which will overcome the above limitations and disadvantages which in particular is provided with a quick-release hinged handle mechanism by which the same can be opened readily as a totebag and subsequently secured and used as a backrest in a highly stable arrangement.

Another object is to provide a totebag and backrest of the above character in which the quick-release handle is simple in construction and capable of retaining the bag in structurally stable A-frame shape when the bag is used as a backrest, but is easy to uncouple so as to open the bag. Another object of the invention is to provide a totebag and backrest of the above character which is provided with small leg or feet extensions integrally formed therewith for becoming imbedded in sandy locations to assist in stabilizing the same and particularly for stabilizing the releasable hinge mechanism when leaned on as a backrest.

Another object of the invention is to provide a totebag and backrest of the above character in which the fabric bag can be completely assembled and sewn before being assembled to the frame. The latter being readily assemblable from its constituent elements as they are integrated with the bag.

In its most general aspect the present invention is directed to the closure of bags of the type having frame members which extend upwardly and close to form a pair of opposed handles for lifting the bag. As applied to the totebag and body rest herein the bag is usually constructed of fabric to form the peripheral and bottom walls of a totebag which also serve as the front and back support means for the frame when the same is used as a body rest. The frame includes side arms or rails which extend downwardly from the handle top portions and are generally unsupported at the bottom except by the bag itself. The present invention provides a bag closure for the handles in the form of a hinge clamp carried by one handle and extending over the other handle in a manner so as to support the other handle for hinged movement and further to support the other handle against a load tending to twist the angles about an axis between them. The hinge clamp includes means for permitting the other handle to be disengaged and removed from the clamp by an opposite twisting motion as would be applied by the user when desiring to open the bag. When the handles are separated the bag is free to be opened at the top. The hinge clamp is fixedly attached to one handle and curves between the handles before looping over the other handle to support the same. The hinge clamp may be flexible in the form of a loop of material or it may be solid material having an "S" shape and including a release opening dimensioned to an interference fit with the other handle so the same may be engaged into the hinge clamp and removed therefrom with slight resistence giving the feel of a snap closure by providing a specific structure which extends between the handles, the hinge operation thereof is facilitated since the handles are separated by the thickness of material so employed. These and other objects and features of the invention will become apparent from the following description and drawings of which:

BRIEF DESCRIPTION OF THE DRAWINGS

FIG. 4 is a perspective view taken frothe front of the unit of the FIGS. 1 through 3 and showing the same with the seat rest extended from the bottom for the user to sit on and also showing the unit coupled by a hinge so as to provide an "A" frame structure to lean against as a backrest.

FIG. 6C is a detailed cross-sectional view of a third form of leg and rung connection fastening in accordance with the present invention.

FIG. 9 is a more detailed upper elevational view of the unit of FIG. 8 and shows the releasable handle construction of a solid "S" shape member.

FIG. 10 is a cross-sectional view of the releasable handle hinge structure of the unit of FIGS. 8 and 9 and taken along the lines 10—10 of FIG. 9.

FIG. 11 is a perspective view illustrating a modified form of quick-release hinge substantially similar to that of FIGS. 9 and 10 and incorporating a tie for preventing opening of the hinge member.

DETAILED DESCRIPTION OF THE PREFERRED EMBODIMENT

Figure 1:
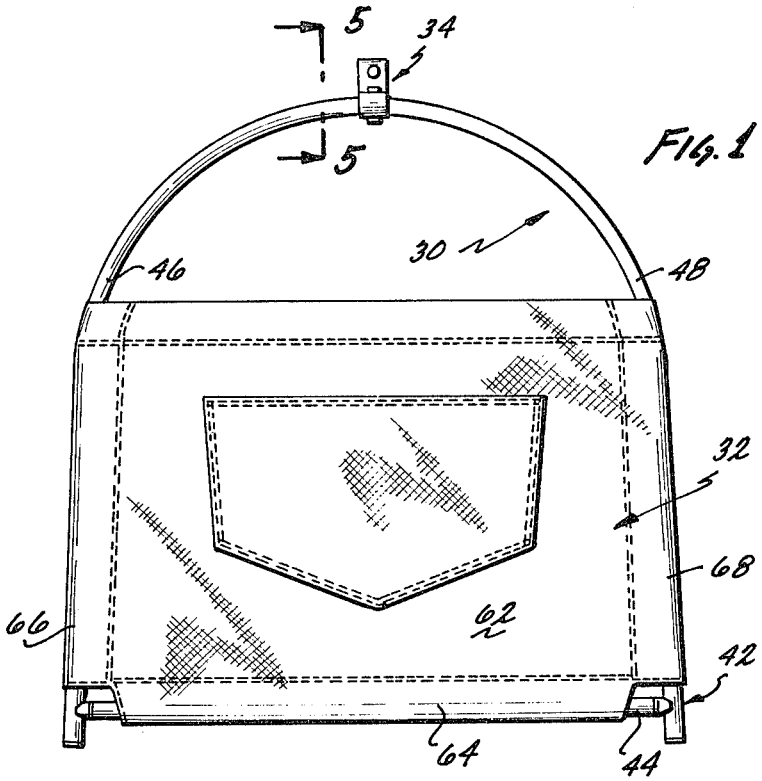
FIG. 1 is an elevational view taken from the rearinvention.

Referring now to the preferred embodiment shown in FIGS. 1 through 7 includes a frame 30, a bag 32, and a releasable handle clasp 34. The frame 30 includes a pair of frame members 40, 42, each having a straight bottom rung 44 connected by suitable means to a pair of upstanding side sections 46, 48 which converge to form arcuate top sections 50, 52 serving as a handle.

Figure 7:
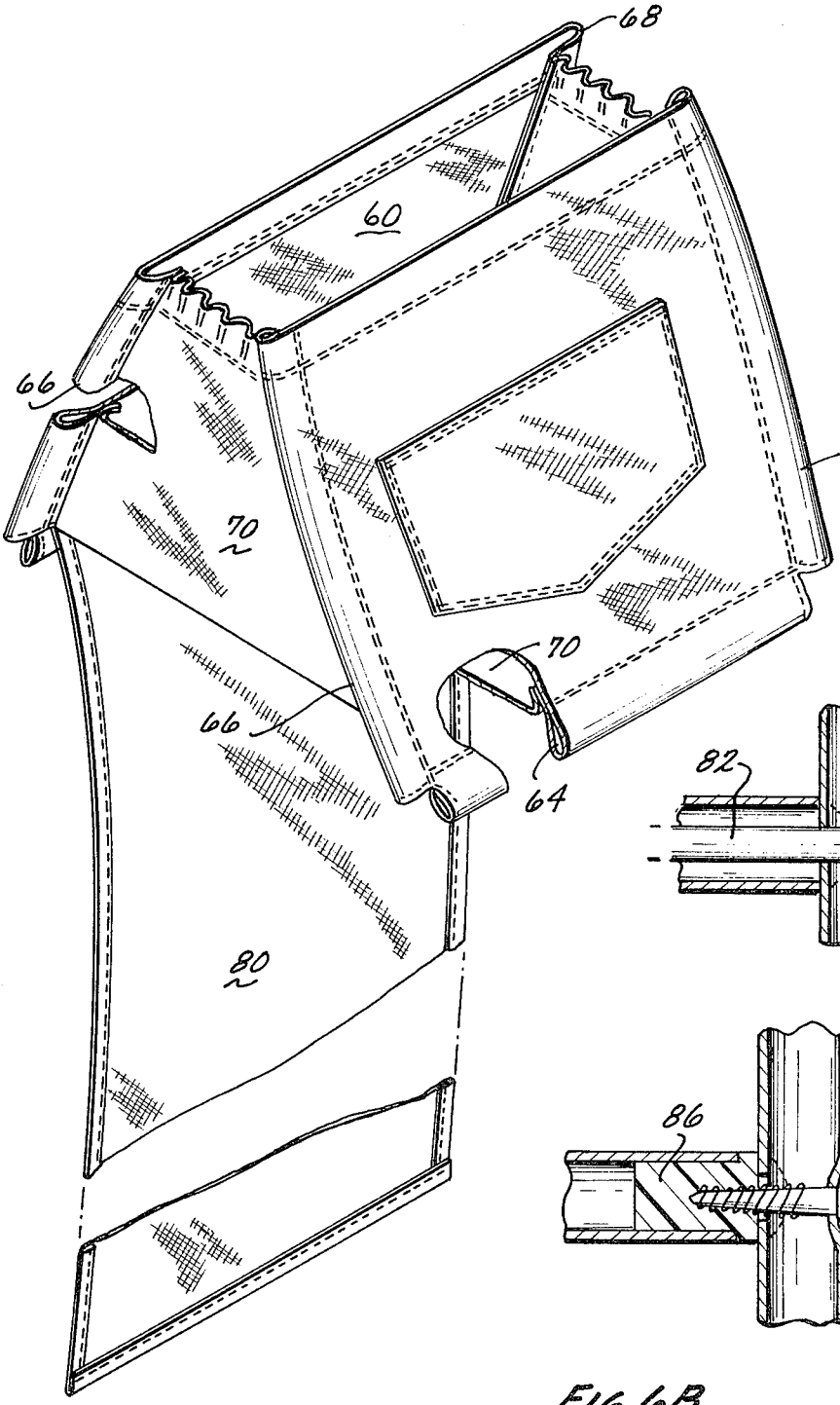
FIG. 7 is a perspective view of the bag portion of the unit of FIGS. 1 through 6 with portions cut away to show the details and method of construction.
Figure 6A:
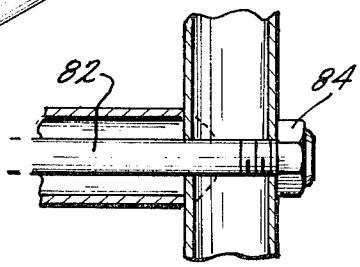
FIG. 6A is a detailed cross-sectional view of one form of leg and rung inner connection in accordance with the present invention.
Figure 6B:
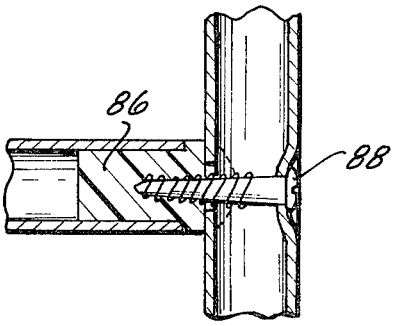
FIG. 6B is a detailed cross-sectional view of a second form of leg and rung connection in accordance with the present invention.
Figure 8:
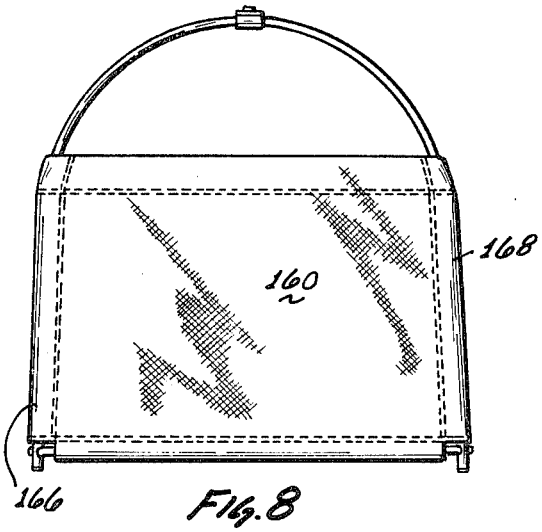
FIG. 8 is an elevational view of a second preferred embodiment of a combination totebag and backrest unit constructed in accordance with the present invention.
Figure 12:
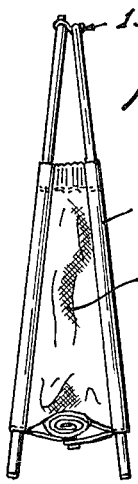
FIG. 12 is a side elevational view of the unit of FIG. 8.
Figure 13:
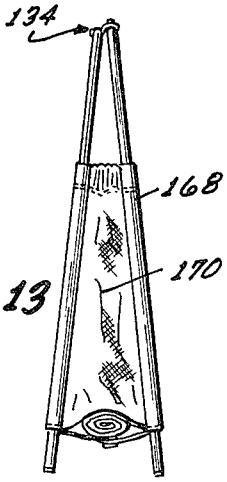
FIG. 13 is a side elevational view taken from the other side of the unit of FIGS. 8 through 12.
Figure 16:
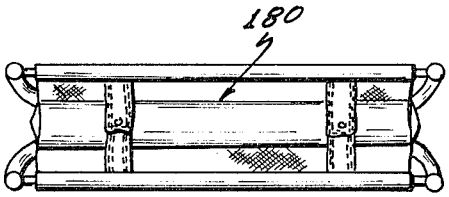
FIG. 16 is a bottom view of the unit of FIG. 8 showing the totebag in a closed position.
Figure 15:
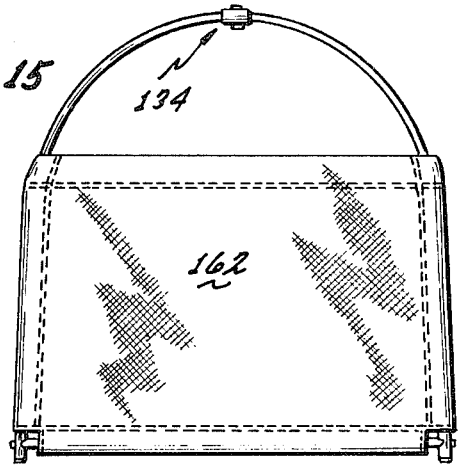
FIG. 15 is a rear elevational view of the unit of FIG. 8.
Figure 18:
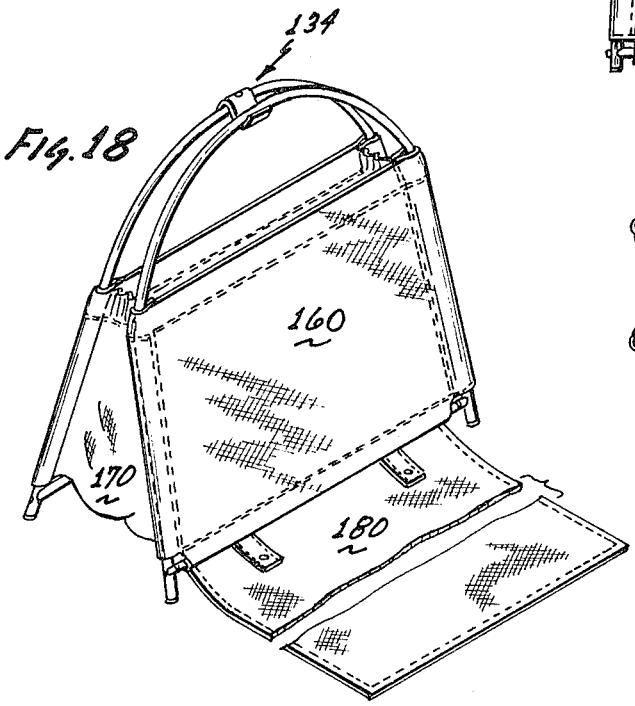
FIG. 18 is a perspective view taken generally from the front showing the unit of FIG. 8 closed but standing in an "A" frame configuration with the seat flap extending outwardly and ready to be used as a backrest.
Figure 14:
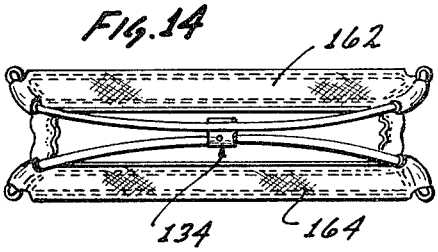
FIG. 14 is a top view of the unit of FIGS. 8 through 12.
Figure 17:
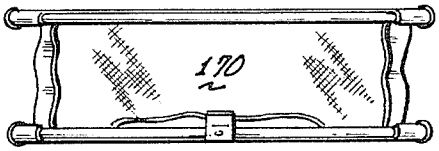
FIG. 17 is a top plan view of the unit of FIG. 8 showing the same in an open position for receiving objects.
Figure 19:
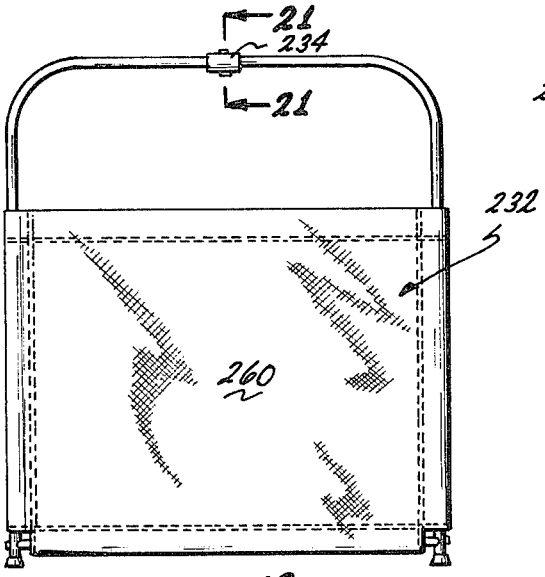
FIG. 19 is a front elevational view of a third preferred embodiment of the present invention.
Figure 20:
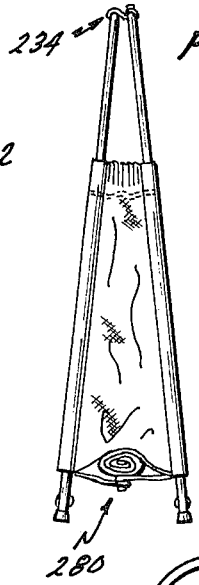
FIG. 20 is a side elevational view of FIG. 19.
Figure 21:
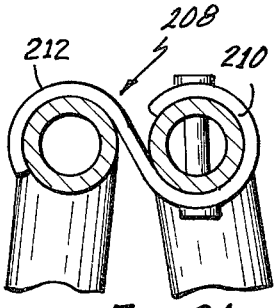
FIG. 21 is a detailed sectional view taken along the lines 21—21 of FIG. 19.
Figure 24:
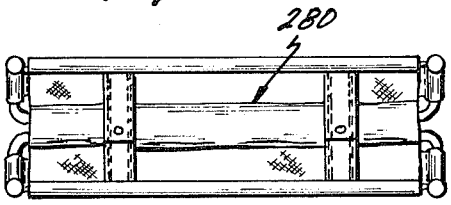
FIG. 24 is a bottom plan view of FIG. 19.
Figure 23:
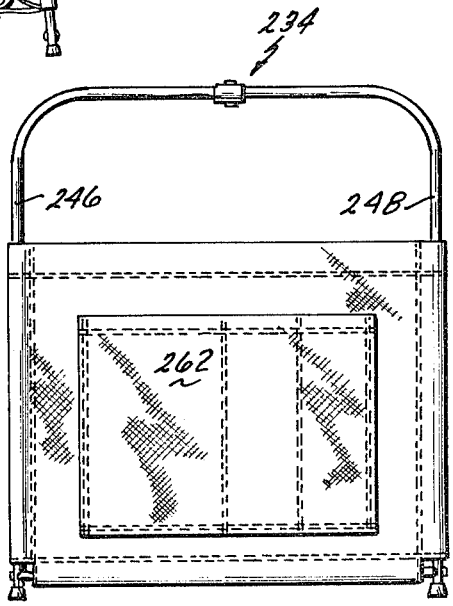
FIG. 23 is a rear elevational view of the unit of FIG. 19.

The bag 32 of the unit comprises flexible fabric which may be independently manufactured and sewn into the final form as shown in FIG. 7, which bag is assembled to the frame sections so as to be secured thereto to cover the bottom and middle portions of the openings defined by and between the frame members and rungs. Thus, front and rear panels 60, 62 are provided, each of the panel members having a bottom edge which wraps around the bottom rung of the respective frame member to form a bottom channel 64 and is secured over to itself by suitable stitching. Similarly, each of the side edge portions of the front and rear panels of the bag is wrapped around the respective upstanding side sections of the frame members 46, 48 to form side channels 66, 68 and are secured to itself by stitching. The bag portion also includes a bottom and side connecting panel 70 of fabric which extends between the frame members and the front and back panels and has its side and bottom edges secured into the bag by suitable stitching.

As seen in detail in FIG. 7, it is preferred that the bag be formed in such a way that the front and back panels form all of the channel elements since this forms a overall structure of smoother contour and provides for integrated sheet of material to extend from all points of strain of the frame members in the plane of the front and rear panels. When used as a back rest, the considerable stresses so created are easily handled by the structure and a rather tight assembly is obtained to provide added comfort to the user. More specifically, the bag is structured as integrally as possible, which is achieved by using a single sheet for each of the front and back panels which is wrapped around the respective frame arm and bottom rung and sewn. And, with this design the bag is formed of three elements sewn together in a minimum number of steps and in a distinct manufacturing operation and completed before assembly to the frame. This is very advantageous since the manufacturing process for the bag, involving fabric cutting, sewing, decoration is completely divorced from that of the frame and handle which involves metal or plastics working, or, for that matter, in wood working.

An elongated seat flap 80 of material is secured at one end by suitable stitching to and in between the front cover panel and the bottom of the bag and when extended lies on the ground to serve as a combination ground cover for the user and as a positioning element for holding the front of the frame at the base as the same is leaned upon. Tabs are provided with snap fasteners so that when the flap is rolled up the same can be secured out of the way underneath the bottom of the bag.

Referring FIGS. 1 through 7 as to the frame structure and the bag of FIG. 7 specifically, it is noted that the sewing operation the bag is complete and requires no further sewing or assembly other than to the frame members. The latter are easily inserted through the side loops or channels so as to extend outwardly and downwardly from the bag after which the cross-rung is positioned and attached to the side arms by any suitable means. One absolutely suitable means is to provide a threaded rod 82 which extends the entire length of the rungs to support the same, passes through holes in the side arms and is secured thereto by cap nuts 84 as shown in FIG. 6A to place the rung in compression. FIG. 6B shows an alternative construction in which the interconnection is made by positioning a T-plug 86 in the end of the rung into which a screw 88 is threaded through the side arm of the frame. FIG. 6C discloses a similar arrangement in which a spring washer 90 having a radially extending plurality of fingers or petals is used, the spring being constructed to be biased to open outwardly against the inside of the rung so that when engaged by the screw, interior friction holds the same in place. Obviously, the specific frame materials and parts cost will dictate the means for attachment. The entire frame may alternatively be constructed of solid polyacrylate material and interconnected by a suitable acrylate solvent or glue. A plastic or wood construction can be implemented by forming a hole or indentation in the side arm into which the rung passes.

The assembly is quick since the rails are extended hrough the bag to extend with the feet on the other side or downward side of the bag, the rung inserted in the lower loop on each side of the bag and readily and quickly fastened into position, after which to totebag is complete. It will be noted that the essential structures of the bag also form a loose support for the framework and that the handles may be readily disengaged by the releasable hinge means to open the bag for insertion of objects, as will be explained.

Means as provided for releasably interconnecting the top handle portions of the first and second frame arms at the top and comprises a curved member of generally S-shape in cross-section and including a portion fixedly attached to one of the handles and another portion looping and encircling the other handle. The loop portion may be solid or of fabric construction as will be seen the several embodiments.

Figure 2:
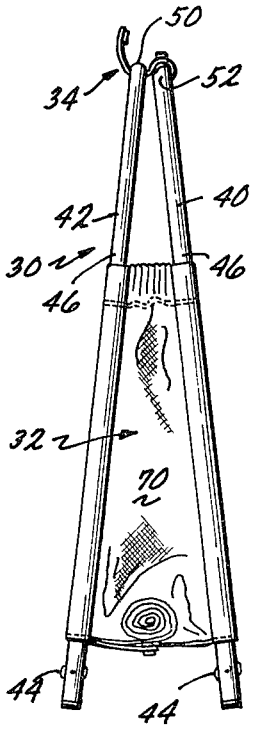
FIG. 2 is a side elevational view of the combination unit of FIG. 1.
Figure 3:
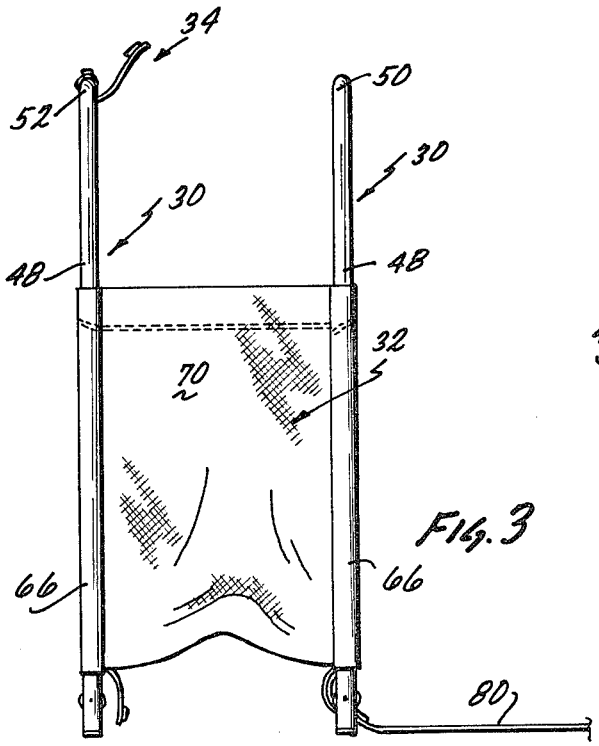
FIG. 3 is side elevation of the other side of the unit of FIG. 1 showing the bag opened for receiving objects.
Figure 5:
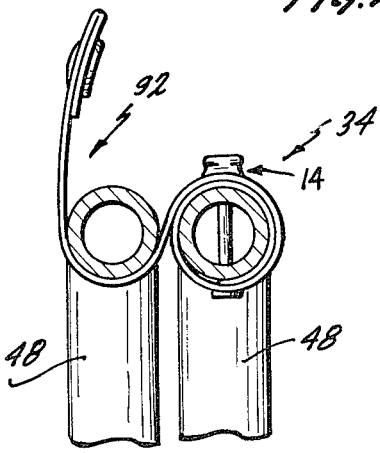
FIG. 5 is a cross-sectional view taken along lines 5—5 of FIG. 1.

FIGS. 1 through 5 illustrate a fabric loop formed so as to extend from the rear frame handle to come downwardly and underneath the front frame handle and loop over and above the same to be snapped by suitable snap means onto the rear handle. In this way the loop resists downward and rearward motion of the front handle since the stress (in the direction of arrow 14) of the same is taken up by pulling the snap normal to its axis. When unsnapped the bag may be opened as shown in FIG. 3 to provide complete access to the interior without interference from the handles. When stored the configuration of FIG. 2 illustrates the compactness of the unit.

The embodiment of FIGS. 8 through 18 illustrates a solid form of releaseable clip assembly wherein like parts have been given like numbers raised by 100. The means of forming the clip loop 100 is of solid material such as metal of which the tubing of the handle is made, as for example aluminum and is formed from a solid strip. Most conveniently, the portion which is fixedly attached to one of the handles may be made in an S-shape which encircles the handle and is attached thereto with a machine screw 102 and nut or rivet to prevent rotation. The other portion 104 curves upwardly to form a hook opening towards the side of the frame that will be leaned against so that that handle moves downwardly into the loop and is supported thereby. Preferably, the loop encircles the free handle slightly more than half way so that the free handle may be inserted and withdrawn from the loop by frictional passage through the restricted area at its top. Thus, the totebag may be easily opened by the user's gripping the handles and giving a slight twist of the wrist. Further, the loop 104 provides a circularly sectioned hinge so that the legs of the frame can be pulled apart at their lower ends to stand in an A-frame configuration, the hinge portion of the loop between the handle giving them adequate separation. Thus, the handle provides the combination of a rotatable hinge as well as a releasable fastening. Since the legs are free to move up and down as well as in and out in all directions, i.e., are essentially unhinged except for connection by the bag, the amount of motion required to release the handles is easily accommodated by the structure.

FIG. 11 shows the use of a tie 106 which may be secured to the handle fastening means so as not to be lost and otherwise simply loops around the handle and may be tied up so as to secure the same against being released by upward motion.

As specifically shown in FIG. 10, the arrow 108 indicates the direction of forceable movement of the front of the bag as the same is leaned upon and shows that the upward facing loop is completely adequate to hold the frame in position. In addition, the partial opening of the loop is shown as closing slightly so as to provide a detent feel and holding action as the handle is inserted or removed.

Figure 26:
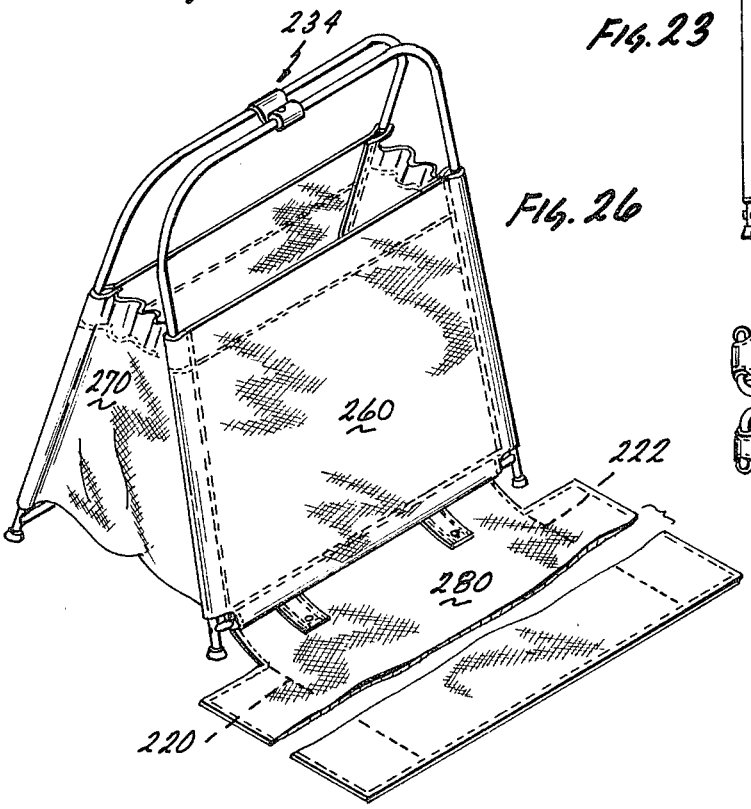
FIG. 26 is perspective view taken generally from the front on the unit of FIG. 19 and showing an extended sitting flap laid out from the front of the unit so that the same is ready to be used as a backrest.
Figure 22:
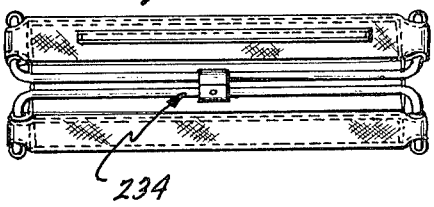
FIG. 22 is a top elevational view of the bag of FIG. 19.
Figure 25:
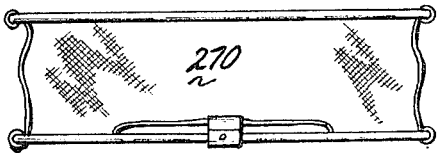
FIG. 25 is a top plan view of the unit of FIG. 19 showing the same open and ready to ready to receive objects.

FIGS. 19 through 26 illustrate a third preferred embodiment of the invention having a somewhat different, more angular, configuration. Like parts have been given numbers similar to FIGS. 1 through 18 but raised by addition of 200. In addition, and most especially, the releasable handle means is the reverse of that shown in the embodiment of FIGS. 8 through 18 in that the closed portion 210 of the releaseable hinge is attached to the front handle member in a fixed relation and orients the loop 212 to open downwardly and rearwardly and cap over the upper side of rear portion. Thus, a leaning force against the front frame handle is countered by upward support of the frame handle so that the frame is stable when used as a back rest. Release of the handles and hinge motion of the handles is the reverse as that previously described. Release of the handles is quite easy since the same twisting of the wrist type motion will as easily disconnect them as in the previous embodiment. FIG. 26 illustrates the further feature of the invention involving a larger flap. It is found that it is useful in many instances to provide a seat flap which extends laterally away from the bag. This is easily done in such a way that by folding the flap over along the dotted lines 220 and 222 the flap size is thereby reduced to that which can be rolled up and tucked underneath the bag.

To those skilled in the art to which the invention pertains many adaptations and modifications thereof will occur so that the scope of the invention should be limited solely by the following claims of which:

I claim:

1. A combination body rest and totebag comprising a frame structure, including a pair of U-shaped members each having a pair of downwardly extending legs interconnected across their upper ends by cross piece portions forming first and second handles, a fabric bag secured about the legs, said bag being shaped to form peripheral walls and a bottom wall of a totebag, said totebag supporting said U-shaped members so that the handles extend in spaced parallel arrangement with respect to each other and can move towards and away from each other to facilitate opening and closing said bag by the user, a rigid hinge clamp carried by one handle and having the shape of an S-curve in cross-section to form first and second sleeves encircling the respective handles, means fixedly attaching said first sleeve over one handle with said second sleeve extending towards and under the other handle, said second sleeve having an upwardly facing opening through which said other handle can pass in interference fit and drop into the second sleeve of the clamp, the first handle and attaching means supporting a load tending to twist the second handle down and around the first handle, said second sleeve being large enough to allow said second handle to rotate therein so that when the second handle is secure in the hinge clamp the legs can be separated by rotation to form a stable A-frame for supporting the weight of the user and whenever desired, the handle can be freed from the clamp by twisting the handles with respect to each other, the second handle snapping up and out of the second sleeve to allow separation of the handles and opening of the totebag.

2. A combination body rest and totebag comprising a frame structure, including a pair of U-shaped members, each having a pair of downwardly extending legs interconnected across their upper ends by cross piece portions forming first and second handles a fabric bag secured about the legs, said bag being shaped to form peripheral walls and a bottom wall of a totebag, said totebag supporting said U-shaped members so that the handles extend in spaced parallel arrangement with respect to each other and can move towards and away from each other to facilitate opening and closing said bag by the user, a rigid hinge clamp carried by one handle and having the shape of an S-curve in cross-section to form first and second sleeves encircling the respective handles, means fixedly attaching said first sleeve under one handle with said second sleeve extending between said handles and towards and over the other handle, said second sleeve having an downwardly facing opening through which said other handle can pass in interference fit and be lifted into the second sleeve of the clamp so that the first handle and attaching means supports a load tending to twist the second handle up and around the first handle, said second sleeve being large enough to allow said second handle to rotate therein so that when the second handle is secure in the hinge clamp the legs can be separated by rotation to form a stable A-frame for supporting the weight of the user, and whenever desired, the handles can be freed from the clamp by twisting the handles with respect to each other, the second handle snapping down and out of the second sleeve to allow separation of the handles and opening of the totebag.

3. A combination body rest and totebag comprising a frame structure, including a pair of U-shaped members, each having a pair of downwardly extending legs interconnected across their upper ends by cross piece portions forming first and second handles a fabric bag secured about the legs, said bag being shaped to form peripheral walls and a bottom wall of a totebag, said totebag supporting said U-shaped members so that the handles extend in spaced parallel arrangement with respect to each other and can move towards and away from each other to facilitate opening and closing said bag by the user, a flexible hinge strap carried by one handle and looped to form an S-curve with first and second loops encircling the respective handles, means fixedly attaching said first loop over one handle with said second loop extending between the handles and towards, under, and around the other handle, said second loop adapted to form an upwardly facing opening for removably encircling said other handle, said second loop continuing to form a flap extendable across the first handle, releasable means for interconnecting the flap and first handle, so that the first handle and attached loop supports a load tending to twist the second handle down and around the first handle, the bight formed in said second loop being large enough to allow said second handle to rotate therein so that when the second handle is secure in the second loop the legs can be separated to form a stable A-frame for supporting the weight of the use, and whenever desired, the handle can be freed by releasing the second loop from the first to allow separation of the handles and opening of the totebag.

4. The combination body rest and totebag as in claim 3 in which said releasable means is a snap fastener.

* * * * *